US012742226B2

(12) United States Patent
Ley et al.

(10) Patent No.: US 12,742,226 B2
(45) Date of Patent: Sep. 22, 2026

(54) INTEGRATION OF CARBON SEQUESTRATION WITH SELECTIVE HYDROMETALLURGICAL RECOVERY OF METAL VALUES

(71) Applicant: NEGATIVE EMISSIONS MATERIALS, INC., New Castle, DE (US)

(72) Inventors: Jeremy William Ley, Paris (FR); David Dreisinger, Delta (CA)

(73) Assignee: NEGATIVE EMISSIONS MATERIALS, INC., New Castle, DE (US)

( * ) Notice: Subject to any disclaimer, the term of this patent is extended or adjusted under 35 U.S.C. 154(b) by 517 days.

(21) Appl. No.: 18/038,813

(22) PCT Filed: Nov. 26, 2021

(86) PCT No.: PCT/IB2021/061024

§ 371 (c)(1),
(2) Date: May 25, 2023

(87) PCT Pub. No.: WO2022/113025

PCT Pub. Date: Jun. 2, 2022

(65) Prior Publication Data

US 2024/0002973 A1 Jan. 4, 2024

Related U.S. Application Data

(60) Provisional application No. 63/118,677, filed on Nov. 26, 2020.

(51) Int. Cl.
*C22B 3/42* (2006.01)
*C22B 3/00* (2006.01)
(Continued)

(52) U.S. Cl.
CPC ..... *C22B 3/42* (2013.01); *C22B 3/08* (2013.01); *C22B 3/10* (2013.01); *C22B 23/043* (2013.01); *C22B 26/22* (2013.01)

(58) Field of Classification Search
CPC .... C22B 3/42; C22B 3/08; C22B 3/10; C22B 23/043; C22B 26/22; C22B 3/22;
(Continued)

(56) References Cited

U.S. PATENT DOCUMENTS 4,367,215 A 1/1983 Gjelsvik et al.
5,780,005 A 7/1998 Olerud
(Continued)

FOREIGN PATENT DOCUMENTS

WO WO-2007039665 A1 * 4/2007 ..... C22B 23/0423
WO 2011-114000 A1 9/2011
(Continued)

OTHER PUBLICATIONS

Roque'-Rosell, J., et al. The accumulation of Ni in serpentines and gernierites from the Falcondo Ni-laterite deposit (Dominican Republic) elucidated by means of μXAS. Geochimica et Cosmochimica Acta 198 (2017) 48-69. (Year: 2017).*
(Continued)

*Primary Examiner* — Anthony J Zimmer
*Assistant Examiner* — Zachary John Baum
(74) *Attorney, Agent, or Firm* — Casimir Jones, S.C.; J. Mitchell Jones

(57) ABSTRACT

Processes are provided in which successive steps of hydrometallurgical value extraction may be carried out using the products of carbon capture and an electrolytic reagent-generating process. The electrolytic process provides an acid leachant and an alkali hydroxide, with the alkali hydroxide then available for use either directly as a precipitant in the hydrometallurgical steps, or available for conversion by
(Continued)

carbon capture to an alkali metal carbonate that can in turn be used as the precipitant in the selective hydrometallurgical steps.

11 Claims, 11 Drawing Sheets

(51) Int. Cl.
*C22B 3/08* (2006.01)
*C22B 3/10* (2006.01)
*C22B 26/22* (2006.01)

(58) Field of Classification Search
CPC ... C22B 23/0461; C22B 3/44; C22B 21/0015; C22B 23/0423; C22B 23/0453; C22B 23/0484; C22B 47/00; C01F 5/22; C01F 5/24; C01F 11/02; C01F 11/181; C01G 49/0045; C01G 49/0072; C01G 53/00; C25B 1/04; C25B 1/22; C25B 1/34
USPC ..... 423/21.5
See application file for complete search history.

(56) References Cited

U.S. PATENT DOCUMENTS

2008/0105088 A1* 5/2008 Ji ..... C22B 3/42 75/739
2011/0091366 A1 4/2011 Kendall et al.
2012/0186398 A1 7/2012 Dreisinger et al.
2015/0202568 A1* 7/2015 Yablonsky ..... B01D 53/60 423/220
2016/0265082 A1 9/2016 Boudreault et al.
2017/0159190 A1 6/2017 Fournier et al.
2017/0240432 A1 8/2017 Jung et al.
2020/0157696 A1 5/2020 Cardarelli

FOREIGN PATENT DOCUMENTS

WO WO-2013188922 A1 * 12/2013 ..... C22B 3/26
WO WO-2015058239 A1 * 4/2015 ..... C01B 33/12
WO WO-2015192762 A1 * 12/2015 ..... C22B 34/12
WO WO 2016/176772 11/2016
WO WO 2020/011766 1/2020

OTHER PUBLICATIONS

Shaikh, A. A., et al. In situ observation of the conversion of sodium carbonate to sodium carbonate monohydrate in aqueous suspension. Ind. Eng. Chem. Res. 2005, 44, 9921-9930. (Year: 2005).*
English translation of WO-2015192762-A1. (Year: 2015).*
EP Search Report for application No. EP21897298.2, mailed Nov. 13, 2024, 10 pages.
Bach et al., CO2 Removal With Enhanced Weathering and Ocean Alkalinity Enhancement: Potential Risks and Co-benefits for Marine Pelagic Ecosystems, Frontiers in Climate, vol. 1, 2019, p. 7.
International Search Report & Written Opinion for PCT/IB2021/061024, dated Jul. 19, 2022; 10 pages.
Keith et al., Joule, vol. 2, Issue 8, Aug. 15, 2018, pp. 1573-1594.
Matus, et al. Metals 2020, 10, 811; doi:10.3390/met10060811.
McQueen, N., Kelemen, P., Dipple, G. et al. Ambient weathering of magnesium oxide for CO2 removal from air. Nat Commun 11, 3299 (2020). https://doi.org/10.1038/s41467-020-16510-3.

* cited by examiner

INTEGRATION OF CARBON SEQUESTRATION WITH SELECTIVE HYDROMETALLURGICAL RECOVERY OF METAL VALUES

FIELD

The invention is in the field of inorganic chemistry, integrating electrochemical processes with steps of hydrometallurgical value extraction and carbon dioxide capture.

BACKGROUND

Technologies for efficient sequestration of gaseous carbon dioxide are potentially an important tool for addressing anthropogenic climate change. Various approaches have been suggested for sequestering carbon as mineral carbonates, including techniques that accelerate weathering reactions of minerals in ultramafic and mafic source rocks. These enhanced weathering (on land) or ocean alkalinity enhancement (at sea) approaches consume $CO_2$ but are necessarily accompanied by a release of mineral dissolution products such as alkaline species and metal compounds, for example Si, Ca, Mg, Fe, Ni, and Co species. The ecological effect of these processes are uncertain (see Bach et al., $CO_2$ Removal With Enhanced Weathering and Ocean Alkalinity Enhancement: Potential Risks and Co-benefits for Marine Pelagic Ecosystems, Frontiers in Climate, vol. 1, 2019, pg 7). There is a need for processes that integrate carbon capture with the recovery of metal values from mineral feedstocks.

SUMMARY

Processes are provided in which successive steps of hydrometallurgical value extraction are carried out on a mineral feedstock, such as an olivine, mafic, saprolite or ultramafic feedstock. In select embodiments, the products of carbon capture reactions and an electrolytic reagent-generating process are utilized as inputs to hydrometallurgical value recovery steps. The electrolytic process provides the acid leachant (HCl or $H_2SO_4$) and an alkali hydroxide (NaOH or KOH), with the alkali hydroxide then available for use either directly as a precipitant in the hydrometallurgical steps, or available for conversion to an alkali metal carbonate or bicarbonate that can in turn be used as the precipitant in the hydrometallurgical steps. In an alternative embodiment, the alkali hydroxide from the chloralkali process may be used to precipitate a calcium hydroxide product, with the calcium hydroxide product then available for use directly in carbon dioxide gas scrubbing, or for use to accept a carbonate that is provided by a $CO_2$ scrubbing process.

Processes are accordingly provided for the coproduction from mineral feedstocks such as basaltic rocks of less carbon intensive, or carbon negative, nickel, iron, calcium and magnesium hydroxides or carbonates. Basaltic sand materials that include amorphous silicates may also be produced. These processes may involve (1) magnetic separation, (2) hydrochloric or sulfuric acid leaching, (3) selective precipitation of metal hydroxides or carbonates in successive steps, which may involve pH modulation (in select embodiments, nickel may for example be separated using a resin in leach step) (4) electrolysis of a resulting barren solution, for example a chloralkali process for treating $NaCl_{(aq)}$, or an electrolytic salt splitting anion exchange process for treating $Na_2SO_{4(aq)}$, and (5) acid and alkali reagent recycling, for example in the case of a chloralkali process, hydrochloric acid production from the hydrogen and chlorine gas products of the electrolysis.

Process of the invention accordingly provide for the use of less carbon intensive nickel, iron, calcium and magnesium hydroxides or carbonates, as well as olivine and basaltic sand material, including amorphous silicates, in marketable products. These may for example include feedstocks for battery, steel, cement, tyre, glass, aggregate, or concrete industries. Products of the present processes, such as the solid siliceous residue or iron precipitate products, may for example be subject to washing and/or alkalization. The adjustment of pH by way of alkalization (alkali addition) may improve the suitability of the final product, for example to produce a siliceous residue suitable for use as a supplementary cementitious material (SCM) in cements with improved cementitious properties.

The present processes provide avenues for the coproduction of less carbon intensive nickel and iron hydroxides, and this in turn may provide avenues to decarbonate sectors associated with the transition to a low carbon economy—such as electric vehicles and batteries. The invention also facilitates low carbon steelmaking, by compensating carbon heavy pyrometallurgy with a carbon negative magnetic, hydrometallurgical and electrochemical process.

The present processes provide for the coproduction of less carbon intensive amorphous silicates, marketable as a supplementary cementitious material (SCM) for cements, or in the tyre manufacturing industry. Basaltic sand materials may be produced by the present processes, with an inert surface, for example for use as aggregate in concrete mixes. The invention accordingly facilitates the construction of less carbon intensive concrete buildings.

Processes are accordingly provided for processing a comminuted mineral feedstock, comprising:

- optionally magnetically separating material from the comminuted mineral feedstock;
- a) leaching metal values from the comminuted mineral feedstock with an acid leachant, to produce a solid siliceous residue and a loaded leach solution;
- optionally subjecting the loaded leach solution to a resin in leach process so as to selectively remove nickel and cobalt values from the loaded leach solution, to obtain a purified nickel and cobalt combined product,
- optionally, washing and/or alkalization of the solid siliceous residue, for example to form a supplementary cementitious material (SCM) for use in cements;
- b) precipitating iron and/or aluminum from the loaded leach solution with addition of:
- a first alkali metal carbonate or bicarbonate precipitant,
- to produce a carbon dioxide off gas, or,
- a first alkali hydroxide precipitant,
- to produce an Fe/Al depleted solution and an iron and/or aluminum hydroxide or oxide (e.g. hematite) precipitate product;
- optionally, washing and/or alkalization of the iron and/or aluminum hydroxide precipitate product;
- optionally, adding a hematite seed material to the step of precipitating iron and/or aluminum, wherein the iron and/or aluminum hydroxide precipitate product may comprise the hematite seed material, which is then recirculated to the precipitation step;
- c) precipitating nickel and/or cobalt from the Fe/Al depleted solution or from a Ni/Co ion exchange eluant obtained from the Fe/Al depleted solution by selective extraction of Ni and/or cobalt on an ion exchange medium, wherein the precipitating is with addition of:

a second alkali metal carbonate or alkali metal bicarbonate precipitant, or, a second alkali hydroxide precipitant, to produce a Ni/Co depleted solution and a nickel and/or cobalt carbonate or hydroxide precipitate product;

d) before or after step (c), precipitating iron and/or aluminum and/or manganese from the Ni/Co depleted solution with addition of an oxidant and with addition of:

a third alkali metal carbonate or bicarbonate precipitant, or, a third alkali hydroxide precipitant, to produce an Fe/Al/Mn depleted solution and an iron and/or aluminum and/or manganese hydroxide precipitate product;

optionally recycling a brine comprising the Fe/Al/Mn depleted solution to a comminuting step to provide the comminuted mineral feedstock;

e) precipitating magnesium from the Fe/Al/Mn depleted solution with addition of:

a fourth alkali hydroxide precipitant, or a fourth alkali metal carbonate or bicarbonate precipitant, to produce a Mg-depleted solution and a magnesium hydroxide or carbonate precipitate product;

f) subjecting the Mg-depleted solution to an electrolysis process to produce the acid leachant and:

one or more of the alkali hydroxide precipitants, or an alkali hydroxide product, available for conversion into one or more of the alkali metal carbonate or bicarbonate precipitants; and, g) optionally sequestering carbon dioxide from a $CO_2$ containing gas, for example by reaction with the alkali hydroxide product, and/or in one or more of: the nickel and/or cobalt carbonate precipitate product; or, the magnesium hydroxide precipitate product.

Processes may further include scrubbing carbon dioxide from a $CO_2$ containing gas, including ambient air, by treating the $CO_2$ containing gas with a scrubbing solution comprising the alkali hydroxide precipitant, to produce one or more of the alkali metal carbonate or bicarbonate precipitants.

Processes are according provided for processing a comminuted mineral feedstock, comprising:

a) leaching metal values from the comminuted mineral feedstock with an acid leachant, to produce a solid siliceous residue and a loaded leach solution;

b) precipitating iron and/or aluminum from the loaded leach solution with addition of:

a first alkali metal carbonate precipitant, to produce a carbon dioxide off gas, or, a first alkali hydroxide precipitant, to produce an Fe/Al depleted solution and an iron and/or aluminum hydroxide or oxide precipitate (such as hematite) product;

c) precipitating nickel and/or cobalt from the Fe/Al depleted solution or from a Ni/Co ion exchange eluant obtained from the Fe/Al depleted solution by selective extraction of nickel and/or cobalt on an ion exchange medium, wherein the precipitating is with addition of:

a second alkali metal carbonate or bicarbonate precipitant, or, a second alkali hydroxide precipitant, to produce a Ni/Co depleted solution and a nickel and/or cobalt carbonate or hydroxide precipitate product, such as a mixed Ni/Co hydroxide product;

d) before or after step (c), precipitating iron and/or aluminum and/or manganese from the Ni/Co depleted solution with addition of an oxidant (such as chlorine gas ($Cl_{2(g)}$) or sodium hypochlorite (NaOCl)) and with addition of:

a third alkali metal carbonate or bicarbonate precipitant, or, a third alkali hydroxide precipitant, to produce an Fe/Al/Mn depleted solution and an iron and/or aluminum and/or manganese hydroxide precipitate product;

e) precipitating magnesium from the Fe/Al/Mn depleted solution with addition of:

a fourth alkali hydroxide precipitant, or a fourth alkali metal carbonate or bicarbonate precipitant, to produce a Mg-depleted solution and a magnesium hydroxide or carbonate precipitate product;

f) subjecting the Mg-depleted solution to an electrolysis process to produce the acid leachant and:

one or more of the alkali hydroxide precipitants, or an alkali hydroxide product.

Processes may further involve reacting the alkali hydroxide product of the electrolysis process directly or indirectly with a carbon source to produce one or more of the alkali metal carbonate or bicarbonate precipitants. The step of reacting the alkali hydroxide product with a carbon source may involve scrubbing carbon dioxide from a $CO_2$ containing gas by treating the $CO_2$ containing gas with a scrubbing solution comprising the alkali hydroxide product, to produce one or more of the alkali metal carbonate or bicarbonate precipitants.

In select embodiments, calcium may be precipitated from the Mg-depleted solution with a fifth alkali hydroxide precipitant, to produce a calcium hydroxide product, and generating one or more of the alkali metal carbonate or bicarbonate precipitants by treating the calcium hydroxide product with a carbon source, such as a $CO_2$ containing gas or a metal carbonate, and the $CO_2$ containing gas may for example be air. When the alkali hydroxide product comprises NaOH, scrubbing carbon dioxide from the $CO_2$ containing gas may accordingly involve precipitating $Na_2CO_3$ hydrates from the scrubbing solution in a crystallisation process to produce a solid $Na_2CO_3$ crystallizer product, and one or more of the alkali metal carbonate or bicarbonate precipitants comprises the solid $Na_2CO_3$ crystallizer product.

In alternative embodiments, the alkali metal carbonate or bicarbonate precipitant may be one or more of $NaHCO_3$, $Na_2CO_3$ or $K_2CO_3$, or a mixture thereof. The alkali hydroxide precipitant may be one or both of NaOH or KOH, or a mixture thereof. The acid leachant may for example be a mineral acid, such as HCl or $H_2SO_4$, or a mixture thereof.

The electrolysis process may involve a chloralkali process, producing the alkali hydroxide precipitant and/or the alkali hydroxide product, a $Cl_{2(g)}$ product and a $H_{2(g)}$ product. The $Cl_{2(g)}$ product and the $H_{2(g)}$ product may then be reacted to produce HCl as the acid leachant.

When the Mg-depleted solution includes $Na_2SO_4$, the electrolysis process may involve a salt splitting process that includes electrolytic generation of: the alkali hydroxide product and/or the alkali hydroxide precipitant; and, $H_2SO_4$ as the acid leachant.

Precipitating magnesium from the Fe/Al/Mn depleted solution with the alkali hydroxide precipitant, may involve addition of a $CO_{2(g)}$ precipitant to produce the Mg-depleted solution and the magnesium carbonate precipitate product. The $CO_{2(g)}$ precipitant may for example include, or be made entirely from, the carbon dioxide off gas from the step of precipitating iron and/or aluminum from the loaded leach solution.

In select embodiments, an initial step of magnetically separating material from the comminuted mineral feedstock may be implements, for example so as to enrich the feedstock in select materials.

In select embodiments, the loaded leach solution may be subjected to a resin in leach process so as to selectively remove nickel values from the loaded leach solution, to obtain a purified nickel product.

The products of the process may be further treated for example by washing and/or alkalization of the solid siliceous residue, washing and/or alkalization of the iron and/or aluminum hydroxide or oxide precipitate product.

A hematite seed material may be added to the step of precipitating iron and/or aluminum so as to seed the precipitation of a hematite product. When the iron and/or aluminum hydroxide or oxide precipitate product comprises a hematite seed material, the hematite seed material may be recirculated to the step of precipitating iron and/or aluminum so as to seed the precipitation of a hematite product.

A brine that includes some or all of the Fe/Al/Mn depleted solution may be recirculated to the comminuting step, to provide the comminuted mineral feedstock.

The mineral feedstock may for example be, or include, one or more of a nickel saprolite ore or tailing, an olivine ore or tailing, an asbestos ore or tailing, a mafic mineral, a saprolite material, an ultramafic rock, olivine, wollastonite or combinations thereof.

DETAILED DESCRIPTION

Processes are provided in which successive steps of hydrometallurgical value extraction are carried out using the products of carbon capture and an electrolytic reactant regeneration process, such as a chloralkali process or an electrolytic salt splitting anion exchange process. The electrolytic reactant regeneration process provides an acid leachant and an alkali hydroxide, with the alkali hydroxide (e.g. NaOH) then available for use either directly as a precipitant in the hydrometallurgical steps, or available for conversion to an alkali metal carbonate (e.g. $Na_2CO_3$) or bicarbonate (e.g. $NaHCO_3$) that can in turn be used as the precipitant in the hydrometallurgical steps.

In an alternative embodiment, the alkali hydroxide from the chloralkali process may be used to precipitate a calcium hydroxide product, with the calcium hydroxide product then available for use directly in carbon dioxide gas scrubbing, or for use to accept a carbonate that is provided by a $CO_2$ scrubbing process.

In some embodiments, a crystalliser step may be introduced to precipitate $Na_2CO_3$ or $Na_2CO_3$ hydrates from a $CO_2$ enriched solution that is being treated with the alkali hydroxide (NaOH) product of the chloralkali process. In such processes, a crystalliser may be used to reduce water content in the hydrates by modulating temperature, pressure and NaOH concentration. The solid $Na_2CO_3$ product may then be used as a carbonate precipitant.

By using a carbonate precipitant to precipitate iron and aluminum from the leach solution, at a suitably low pH, the carbonate will decompose to release a concentrated stream of $CO_2$, and the concentrated $CO_2$ stream may in turn be sequestered or fixed.

Figure 1:
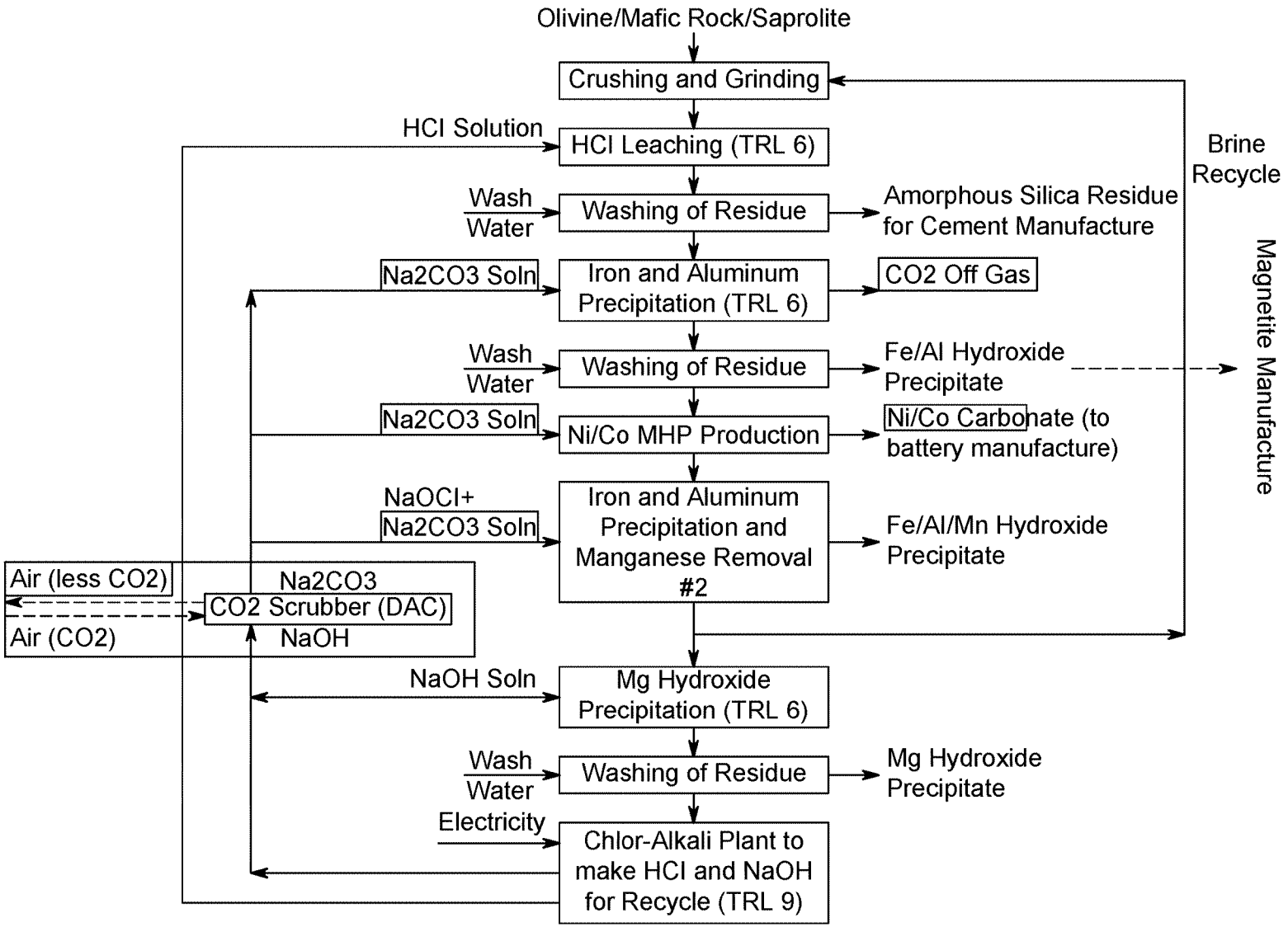
FIG. 1 is a schematic illustration of an integrated process for hydrometallurgical value extraction from a mineral feedstock, with reactants for the hydrometallurgical process provided by capture of carbon dioxide and a chloralkali electrochemical process.

FIG. 1 illustrates a process in which metal values are leached from a comminuted ("crushing and grinding") mineral feedstock with an acid leachant ("HCl leaching"), to produce a solid siliceous residue ("Amorphous Silica Residue for Cement Manufacture") and a loaded leach solution. As illustrated, the residue may be washed. Crushing and grinding in a recycled brine solution containing a variety of chloride or sulfate salts, such as magnesium and sodium salts, may be carried out so as to avoid or minimize the need for the addition of non-brine water. HCl acid leaching may be carried out at relatively high acid concentrations, such as 30-36% HCl by weight in water—a typical product from an HCl production facility attached to a chlor-alkali plant.

Figure 11:
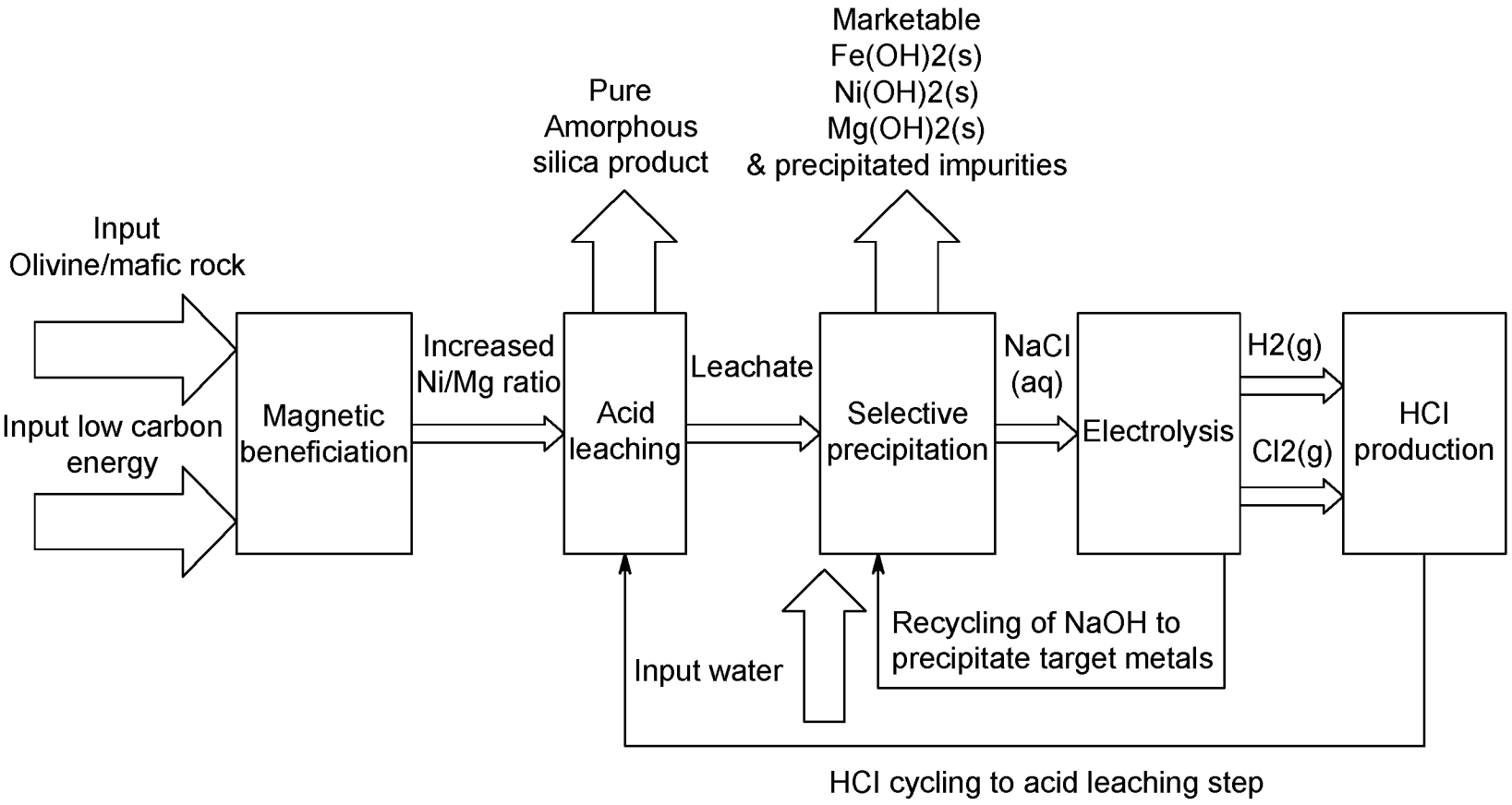
FIG. 11 is a schematic illustration of an integrated process for hydrometallurgical value extraction from a mineral feedstock, which includes an initial step of magnetic beneficiation to adjust the metal content of the treated material.

As illustrated in FIG. 11, in an embodiment of the invention, the ferromagnetic content of the crushed ore may be modulated using a magnetic separator, for example so as to increase or decrease the iron and nickel hydroxide products of the process. For example, with an (ultra)mafic sand input comprising olivine or wollastonite, the ratio of $MgSiO_4$ and $CaSiO_4$ content to nickel and iron may be optimised via magnetic separation. In a further alternative, a resin in leach process may be used to selectively remove nickel content in the acidic leach prior to selective precipitation steps, to obtain a purified nickel product.

Conditions for leaching may include a leaching temperature of from 80° C. to boiling point, to 115° C. or higher. Acid addition during HCl leaching may for example range from 500 to 1000 kg HCl per dry tonne of solid feed, varying with the chemical composition of the feed. Leaching times may for example be for effective residence times of from 1 hour to 8 hours. Leaching may for example be carried out in a single stage or two or more countercurrent stages. In a single stage process, the acid and ore are added together and allowed to react at a leaching temperature to completion. In a multistage leach, fresh ore is contacted with partly reacted solution so as to maximize the use of the acid (low terminal acidity) and in the second or subsequent stage, the partly leached ore (from the first stage) is contacted with high acid to maximize extraction of Mg/Ni/Co/Fe, etc. The multistage process may involve additional solid/liquid separation steps to ensure countercurrent movement of solids and liquids.

The raw materials for the present processes may contain a variety of silicate minerals including magnesium, iron, nickel and cobalt and minor impurity elements. The chemistry of acid leaching, with HCl, may therefore be represented the following reactions:

$$Mg_2SiO_4+4HCl=2MgCl_2+SiO_2+2H_2O$$

$$Ni_2SiO_4+4HCl=2NiCl_2+SiO_2+2H_2O$$

$$Fe_2SiO_4+4HCl=2FeCl_2+SiO_2+2H_2O$$

Other minerals present in source materials such as iron oxides or aluminum oxides may also react with HCl to form additional salts in solution:

$$FeO(OH)+3HCl=FeCl_3+2H_2O$$

$$AlO(OH)+3HCl=AlCl_3+2H_2O$$

Natural mineral source materials are of course not pure compounds, so that the source minerals my contain a variety of elements (eg. Mg, Ni, Co, Fe in one silicate mineral) and may be hydrated or weathered. Geological descriptions of suitable feed materials include: nickel saprolite ores, olivine ores, and asbestos ores and tailings.

The product of HCl leaching is a weakly acidic solution containing various chloride salts. A silica rich residue is recovered as a solid product. This residue may for example be washed to remove salts and excess acid with fresh water, and/or alkalized (alkali conditioning) with a base to adjust pH, and then directed to cement manufacture where the silica may be used as a replacement for other materials (thus lowering the carbon intensity of cement manufacture) and as a strengthener to improve the yield strength of concrete, with the silica acting as a supplementary cementitious material (SCM) in a high performance concrete.

Iron and/or aluminum are precipitated ("Iron and Aluminum Precipitation") from the loaded leach solution with an alkali hydroxide (NaOH) or alkali metal carbonate or bicarbonate precipitant ($Na_2CO_3$ as illustrated in FIG. 1). When $Na_2CO_3$ is used as a precipitant, this produces a carbon dioxide off gas ("$CO_2$ Off Gas"), an Fe/Al depleted solution and an iron and/or aluminum hydroxide or oxide precipitate product ("Fe/Al Hydroxide Precipitate" as illustrated, comprising magnetite in select embodiments). As illustrated, the residue is washed to provide the precipitate. When an alkali hydroxide (e.g. KOH or NaOH) is used as the precipitant, the iron and aluminum content in the solution is generally precipitated as a mix of oxide and hydroxide solids by raising the pH with an alkali hydroxide (KOH or NaOH) solution. The NaOH solution may for example be added as a 50% solution, and may be diluted with recycled brine solution for process convenience and enhanced pH control (it may be hard to control pH when adding a very strong base). The added NaOH neutralizes excess acid and precipitates Fe/Al and other trivalent cations if present:

$$HCl+NaOH=NaCl+H_2O$$

$$FeCl_3+3NaOH=FeO(OH)+3NaCl+H_2O$$

$$2FeCl_3+6NaOH=Fe_2O_3(\text{hematite})+6NaCl+3H_2O$$

$$AlCl_3+3NaOH=AlO(OH)+3NaCl+H_2O$$

$$2AlCl_3+6NaOH=Al_2O_3+6NaCl+3H_2O$$

$$CrCl_3+3NaOH=CrO(OH)+3NaCl+H_2O$$

$$2CrCl_3+6NaOH=Cr_2O_3+6NaCl+3H_2O$$

The pH adjustment may for example be conducted with stoichiometric amounts of alkali hydroxide. Over-addition of NaOH may result in precipitation of Ni/Co (undesirable) so control of base addition must be maintained. The Fe/Al precipitation temperature may for example be 75° C. to boiling point. Seed (precipitate) may be recycled, for example in the form of hematite, to ensure growth of suitably sized particles, and materials, for enhanced solid/liquid separation. An initial mineral seed, such as hematite, may be used to initiate the process of precipitating a select material, such as hematite. Fe/Al precipitation time may for example be 1 to 8 hours. NaOH may for example be added progressively through precipitation tanks (continuous) so as to enhance precipitation of coarser/separable precipitates. The Fe/Al precipitation product may be separated by S/L separation and washed.

The Fe/Al precipitation residue may for example be treated to form commercial products, such as hematite. For example, drying and partial reduction may be used to form magnetite and a mixed Al/Cr oxide. The magnetite can be separated using magnetic separation and the Al/Cr oxide can be sold as a product for the refractory market.

Nickel and cobalt may be selectively recovered in a variety of ways. In an HCl based leaching process, Ni and Co will be present in solution as $NiCl_2$ and $CoCl_2$ salts, and these salts can be recovered by ion exchange, for example using a Dow M4195 resin to extract Ni and Co in a Na-form resin. The resin can then be stripped with HCl solution to form a strong, purified solution of Ni/Co chloride salts. The resin may then be treated with NaOH solution after acid stripping to return to the resin "loading" step.

In select embodiments, the recovery of Ni/Co is by way of a mixed hydroxide precipitate (MHP). This can be done directly from the solution coming from the iron precipitation step, or can be effected starting with the ion exchange eluant containing nickel and cobalt chloride. In these processes, a solution of sodium hydroxide is added to from the precipitates:

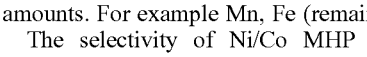

$$NiCl_2+2NaOH=Ni(OH)_2+2NaCl$$

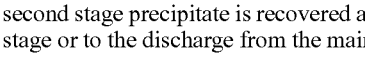

$$CoCl_2+2NaOH=Co(OH)_2+2NaCl$$

Other metals may also precipitate with the Ni/Co in minor amounts. For example Mn, Fe (remaining iron in solution).

The selectivity of Ni/Co MHP precipitation can be enhanced by using two stage MHP precipitation, in which a second stage precipitate is recovered and recycled to the first stage or to the discharge from the main leaching step (where acid is present to redissolve the Ni/Co and other metals from the second stage leach).

The mixed hydroxide precipitate may be recovered by S/L separation and washing. A pressure filter may be used with a "squeeze" cycle to minimize the entrained moisture in the washed Ni/Co MHP cake prior to shipping.

The Ni/Co MHP precipitation may be carried out between 25-90° C. with a terminal pH in the range of 5-8. The addition of base can also be controlled by stoichiometry rather than, or in addition to, pH. The Ni/Co MHP precipitation time may for example be 1-8 hours. Seed recycling may be used to maximize particle size and minimize contamination. The Ni/Co MHP process (as in all steps) may be conducted continuously.

As illustrated in FIG. 1, in an alternative embodiment nickel and/or cobalt may be precipitated from the Fe/Al depleted solution with a second alkali metal carbonate or bicarbonate precipitant ($Na_2CO_3$ as illustrated), to produce a Ni/Co depleted solution and a nickel and/or cobalt carbonate precipitate product ("Ni/Co Carbonate (to battery manufacture)").

Most of the iron and aluminum are removed from solution in the first iron removal step. Manganese is generally not removed from solution in either the initial iron control or the Ni/Co MHP precipitation steps. Accordingly, a second stage of iron precipitation may be implemented with increased pH so as to maximize the removal of iron with an oxidant added to oxidize Mn and Fe to facilitate more complete removal and purification of all species. Suitable oxidants include gaseous chlorine or sodium hypochlorite (NaOCl). Example reactions include:

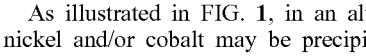

$$2FeCl_2+NaOCl+4NaOH=2FeO(OH)+5NaCl+H_2O$$

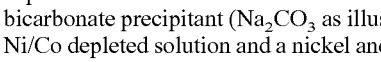

$$MnCl_2+NaOCl+2NaOH=MnO_2+3NaCl+H_2O$$

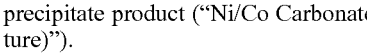

$$AlCl_3+3NaOH=AlO(OH)+3NaCl+H_2O$$

Conditions for iron and/or aluminum and/or manganese scrubbing may be designed to maximize precipitation of the impurity elements while minimizing formation of magnesium hydroxide. The oxidant (eg. NaOCl) may be added so as to achieve a suitably high oxidation/reduction potential (ORP) to maximize the oxidative removal of Fe/Mn. Scrubbing temperature may for example be 25° C. to the boiling point. As in other precipitation steps, seed recycle can be used to improve performance. Scrubbing time may for example be 1 to 8 hours.

Alternatively, as illustrated in FIG. 1, iron and/or aluminum and/or manganese may be scrubbed from the Ni/Co depleted solution with a third alkali metal carbonate or bicarbonate precipitant (also $Na_2CO_3$ as illustrated) and an oxidant, such as the illustrated sodium hypochlorite, to produce an Fe/Al/Mn depleted solution and an iron and/or aluminum and/or manganese hydroxide precipitate product ("Fe/Al/Mn Hydroxide Precipitate"). As illustrated, brine comprising the Fe/Al/Mn depleted solution may be recycled to the comminuting step to provide the comminuted mineral feedstock.

Magnesium remaining in solution may be precipitated from the Fe/Al/Mn depleted solution with an alkali hydroxide precipitant (NaOH as illustrated), to produce a Mg-depleted solution and a magnesium hydroxide precipitate product ("Mg Hydroxide Precipitate"):

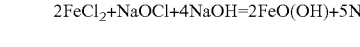

$$MgCl_2+2NaOH=Mg(OH)_2+2NaCl$$

This may for example be carried out by adding NaOH to $MgCl_2$ solution, or by reversing the order of addition. In either case, the process may be carried out so as to provide a near complete removal of Mg as Mg(OH)2 from solution. This generally requires a near stoichiometric addition of NaOH.

Figure 7:
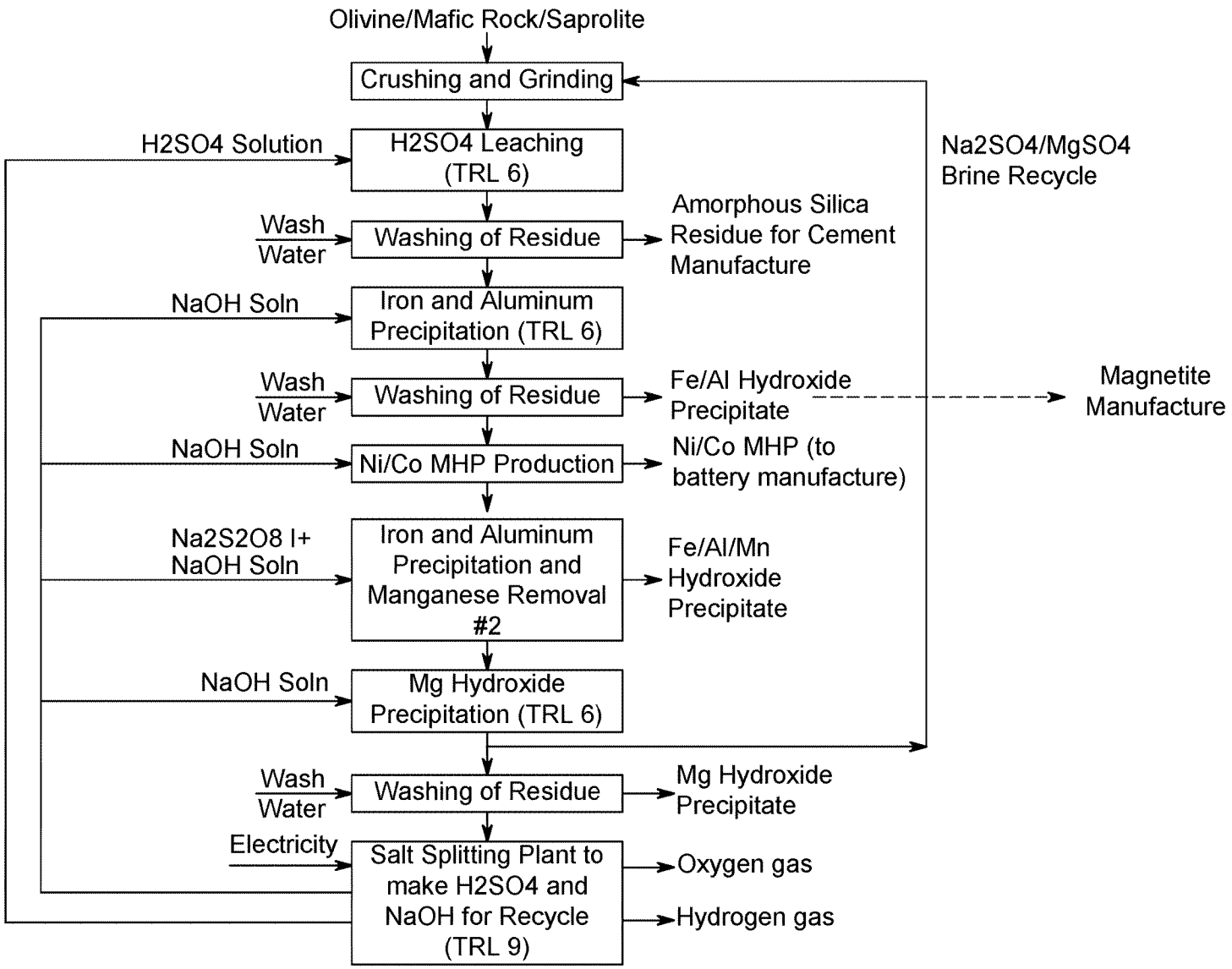
FIG. 7 is a schematic illustration of an integrated process for hydrometallurgical value extraction from a mineral feedstock, with reactants for the hydrometallurgical process provided by an electrolytic salt splitting anion exchange process.

The Mg-depleted solution may then be subjected to further purification, for example in an ion exchange resin separation step, or sent directly to an electrolysis to produce the alkali hydroxide precipitant and the acid leachant (in FIG. 1, "Chlor-Alkali Plant to make HCl and NaOH for Recycle", in FIG. 7 "Salt Splitting Plant to make $H_2SO_4$ and NaOH for Recycle"). Standard chloralkali brine pretreatments may be carried out on the Mg-depleted solution to provide a higher purity Mg-depleted brine, for example essentially free of undesirable solids and ions, for example involving brine saturation/evaporation and softening, for example by primary and polish filtration steps and high-performance ion exchange softening. In an HCl based extraction process, the final Mg-depleted solution is $NaCl_{(aq)}$ with some minor contaminants in solution. This $NaCl_{(aq)}$ solution is directed to a chlor-alkali plant for manufacture of NaOH, $Cl_2$ and $H_2$, involving conventional steps, with the $Cl_2$ and $H_2$ available to be burned and water-scrubbed to form a strong HCl solution for recycle to leaching. Excess heat from $Cl_2$ and $H_2$ combustion may for example be recovered as steam and used to evaporate excess water from solution.

As illustrated in FIG. 1, carbon dioxide may be scrubbed from a $CO_2$ containing gas ("Air" as illustrated) by treating the $CO_2$ containing gas with a scrubbing solution comprising the alkali hydroxide precipitant (NaOH as illustrated), to produce one or more of the alkali metal carbonate or bicarbonate precipitants ($Na_2CO_3$ as illustrated).

In the foregoing process, the step of scrubbing carbon dioxide from the $CO_2$ containing gas may include a crystallisation step to precipitate $Na_2CO_3$ hydrates from the scrubbing solution, the alkali hydroxide precipitant being NaOH. The solid $Na_2CO_3$ crystallizer product may then be directed to provide one or more of the alkali metal carbonate or bicarbonate precipitants.

Figure 2:
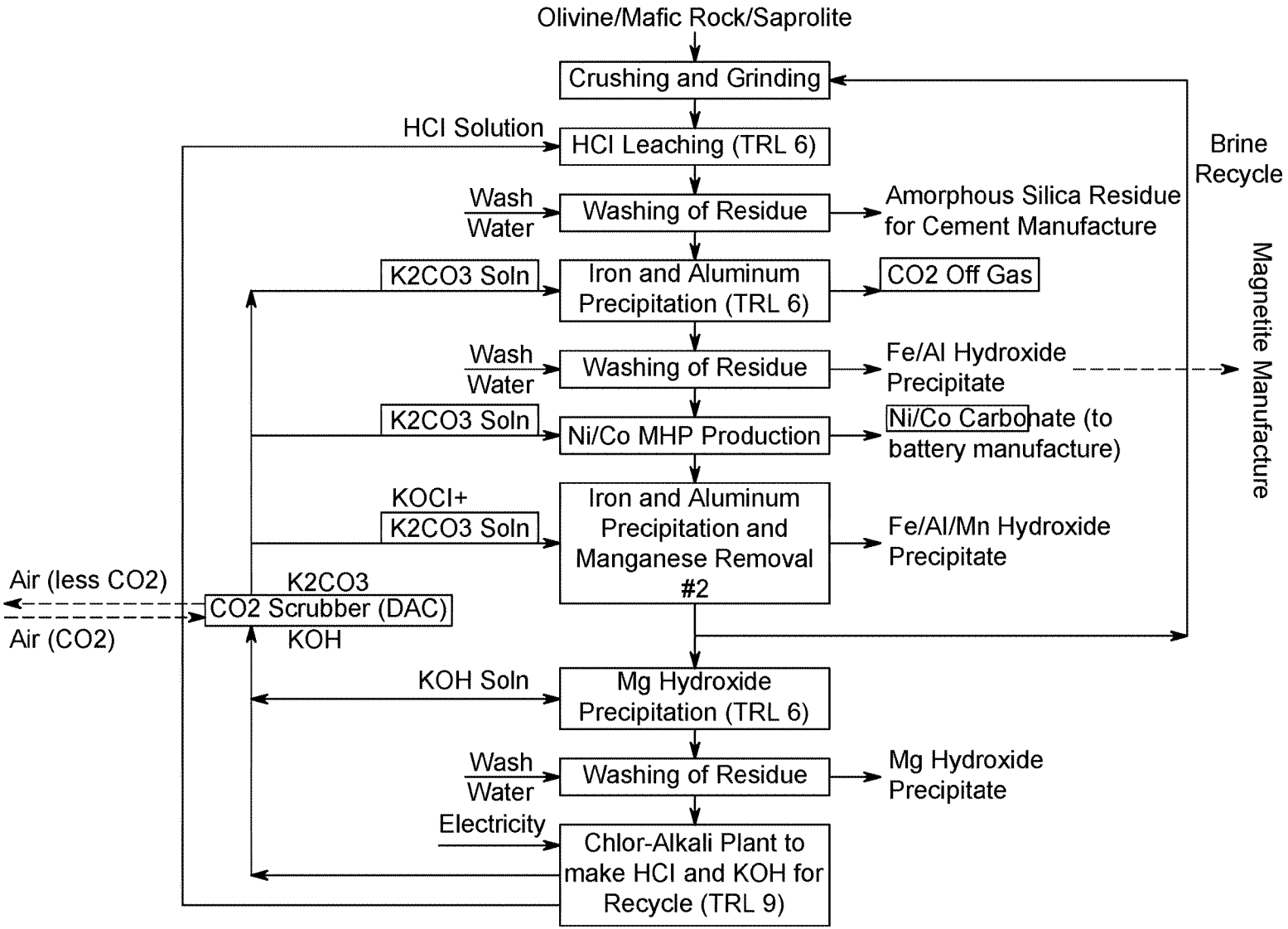
FIG. 2 is a schematic illustration of an integrated process for hydrometallurgical value extraction from a mineral feedstock, with reactants for the hydrometallurgical process provided by capture of carbon dioxide and a chloralkali electrochemical process.

FIG. 2 illustrates a process analogous to the process illustrated in FIG. 1, with potassium compounds in place of the sodium compounds of FIG. 1.

Figure 3:
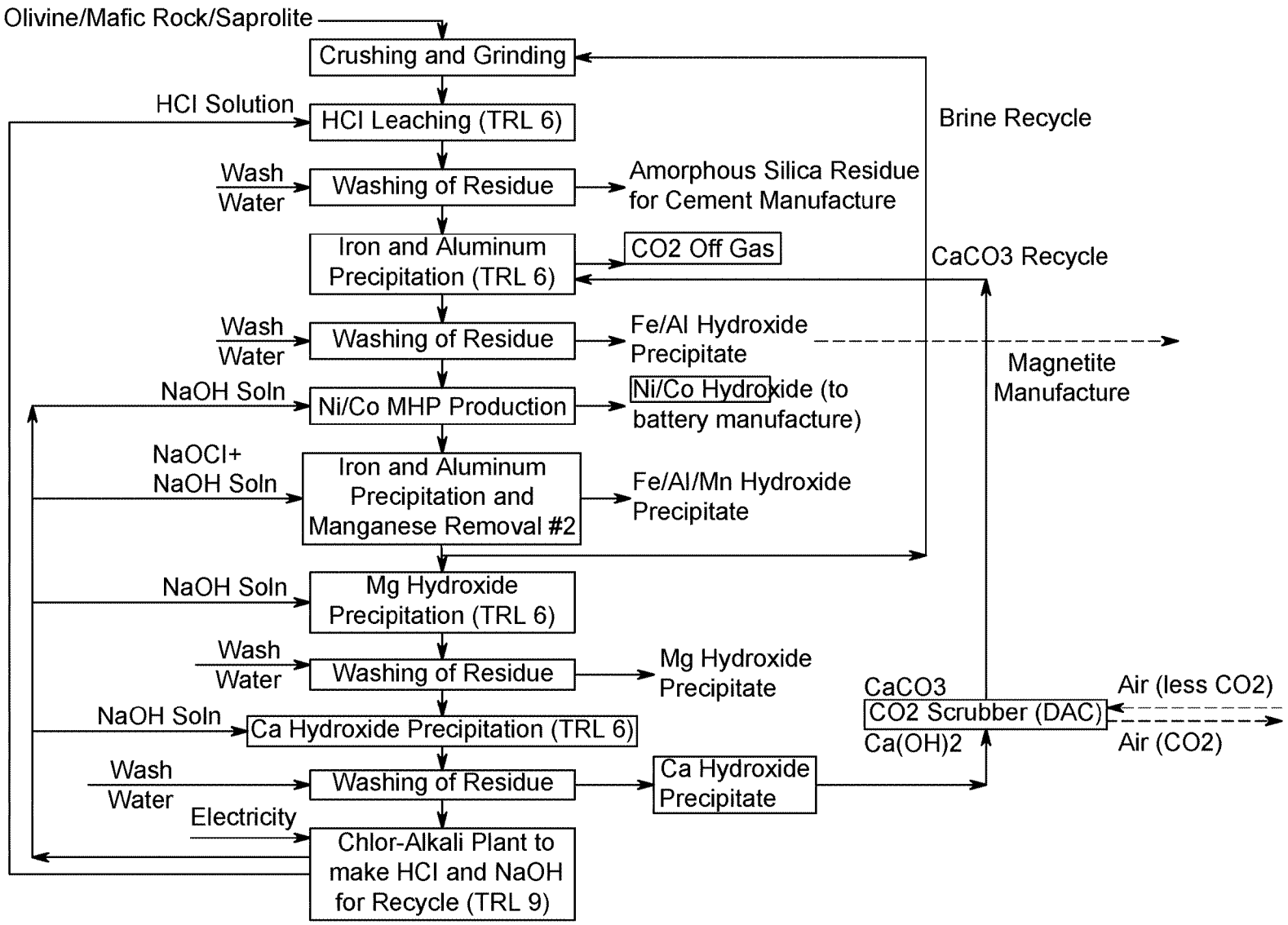
FIG. 3 is a schematic illustration of an integrated process for hydrometallurgical value extraction from a mineral feedstock, with reactants for the hydrometallurgical process provided by capture of carbon dioxide and a chloralkali electrochemical process.
Figure 4:
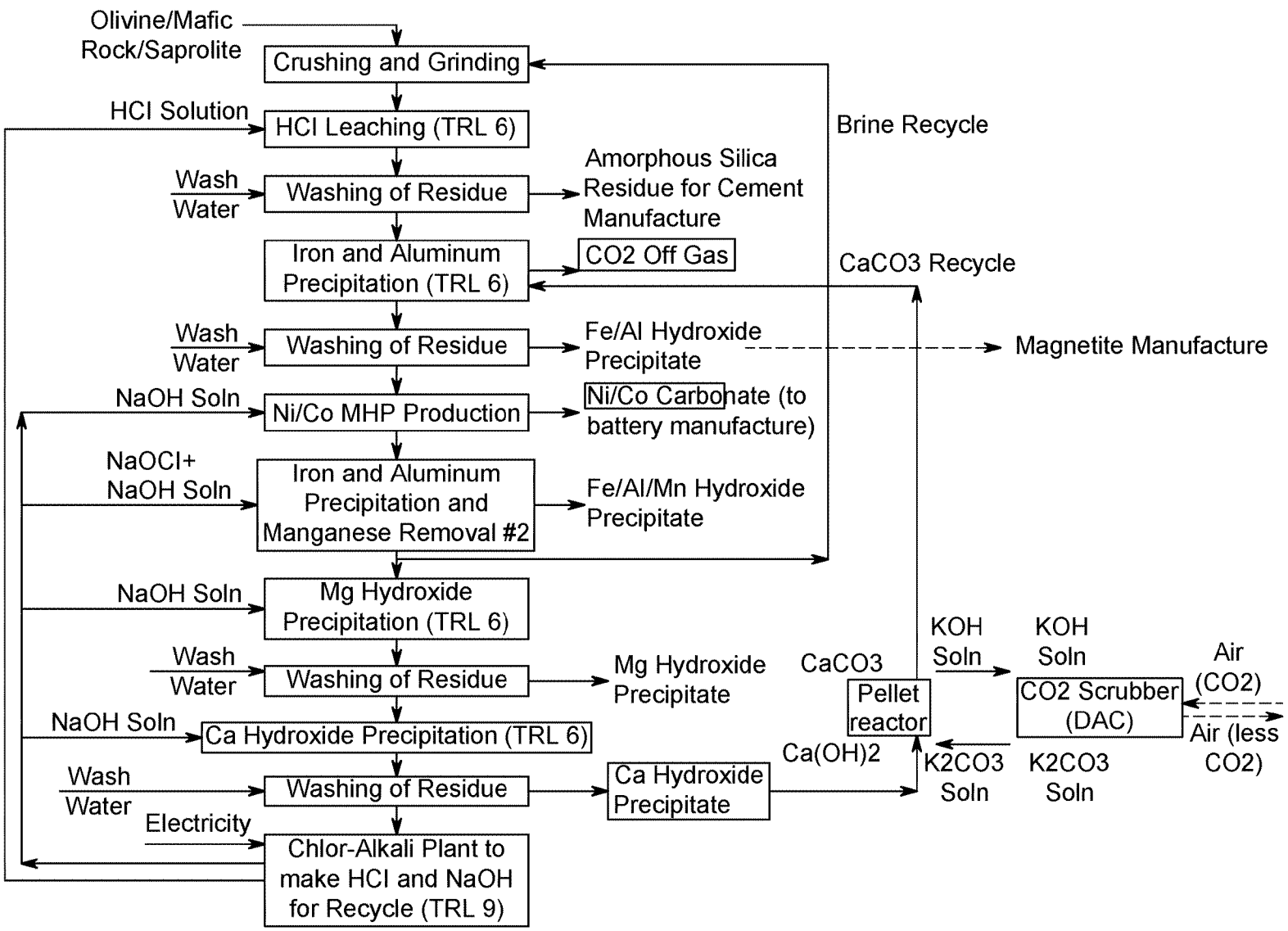
FIG. 4 is a schematic illustration of an integrated process for hydrometallurgical value extraction from a mineral feedstock, with reactants for the hydrometallurgical process provided by capture of carbon dioxide and a chloralkali electrochemical process.

FIG. 3 and FIG. 4 illustrate alternative embodiments which involve precipitating calcium from the Mg-depleted solution with a fourth alkali metal hydroxide precipitant (NaOH as illustrated), to produce a Ca-depleted solution and a calcium hydroxide product. The calcium hydroxide product is then available for carbon sequestration reactions, for example by generating the metal carbonate precipitant for the iron and/or aluminum precipitation step by treating the calcium hydroxide product with a carbon source, such as air (FIG. 3) or a metal carbonate that is in turn derived from KOH-mediated carbon capture (FIG. 4). In these processes, the Ca-depleted solution is subjected to electrolysis to produce one or more of the first, second, third or fourth alkali metal hydroxide precipitants and the acid leachant.

The alkali hydroxide precipitant may accordingly be NaOH (FIGS. 1, 3 and 4) or KOH (FIG. 2). The process acid leachant as illustrated is HCl. These products may be produced in a chloralkali process.

Figure 5:
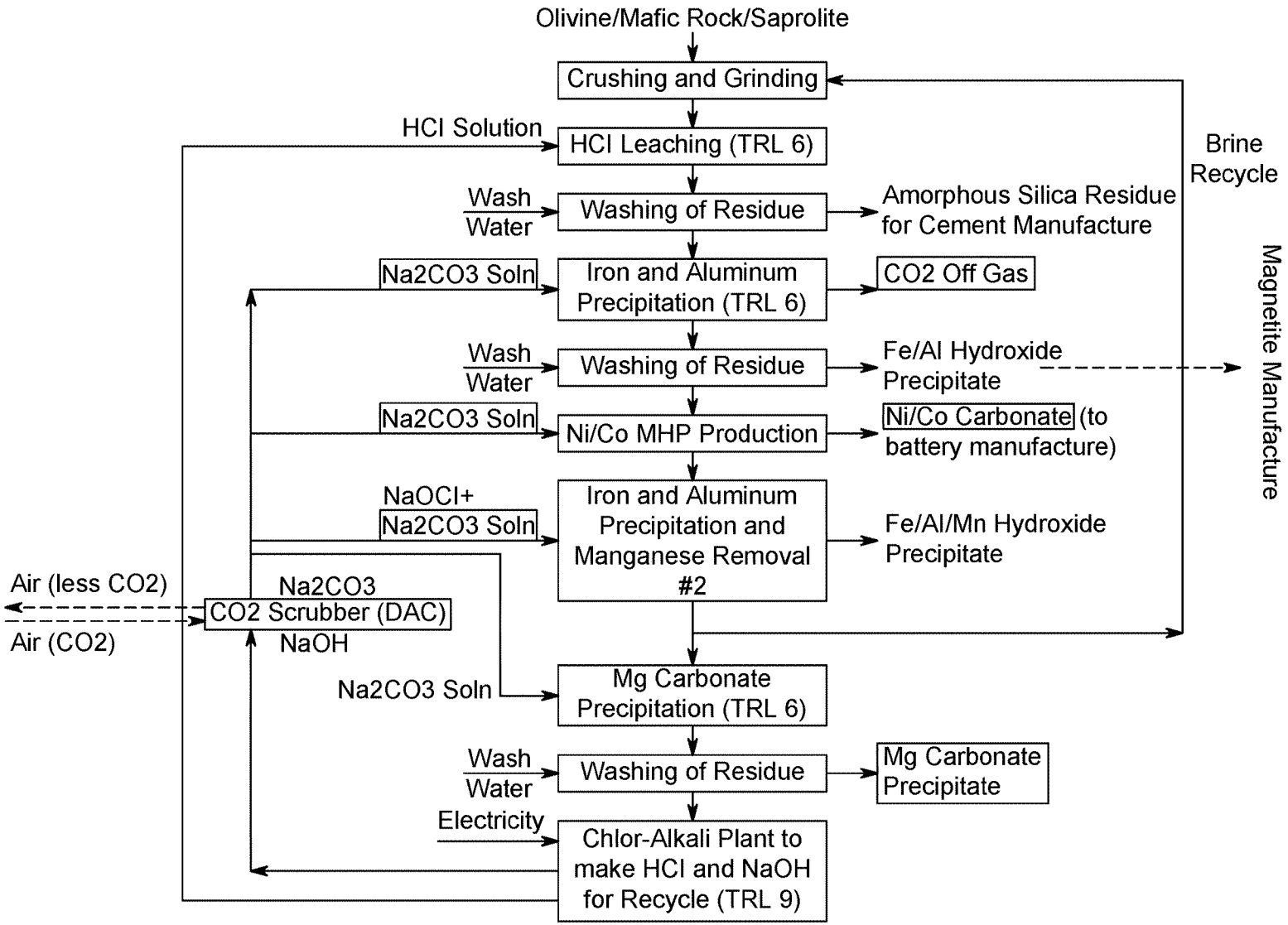
FIG. 5 is a schematic illustration of an integrated process for hydrometallurgical value extraction from a mineral feedstock, with reactants for the hydrometallurgical process provided by capture of carbon dioxide and a chloralkali electrochemical process, showing the use of $Na_2CO_3$ to precipitate Mg.
Figure 6:
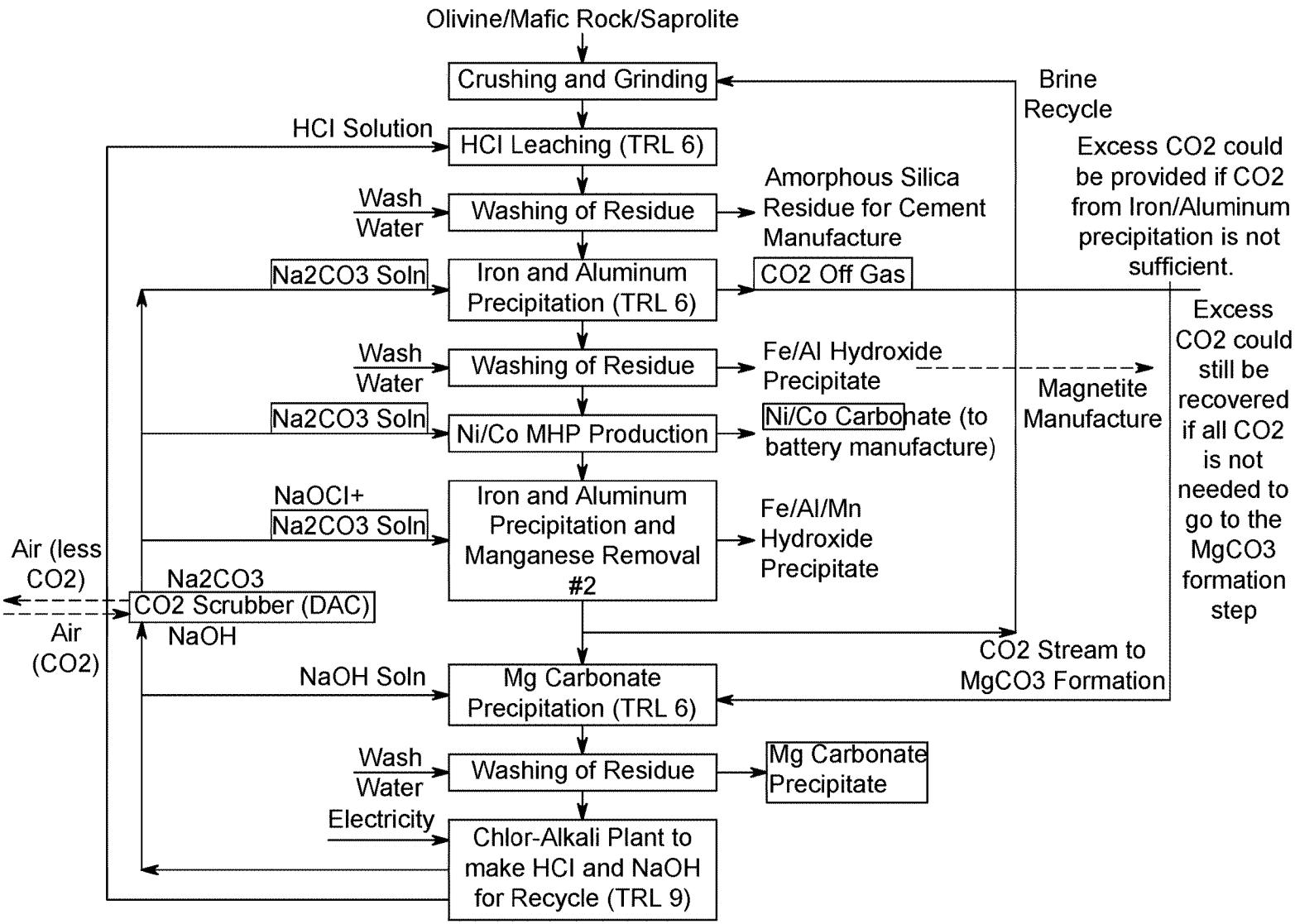
FIG. 6 is a schematic illustration of an integrated process for hydrometallurgical value extraction from a mineral feedstock, with reactants for the hydrometallurgical process provided by capture of carbon dioxide and a chloralkali electrochemical process, showing the use of NaOH in combination with $CO_{2(g)}$ to precipitate Mg.

FIG. 5 and FIG. 6 illustrate alternative embodiments, in which alternative pathways are used to form $MgCO_3$ rather than $Mg(OH)_2$ in the magnesium precipitation step. These embodiments reflect adaptations related to the use of $Mg(OH)_2$ from the present processes for: (1) direct air capture (DAC) of $CO_2$ to form $MgCO_3$; or, (2) ocean alkalinity enhancement (OAE) to form $Mg(HCO_3)_2$ by direct addition of $Mg(OH)_2$ to the ocean environment. The use of $Mg(OH)_2$ to form $MgCO_3$ by contact with air containing $CO_2$ can in some circumstances suffer from unfavourable kinetics. The embodiments illustrated in FIG. 5 and FIG. 6 accordingly provide alternative routes to forming $MgCO_3$ in approaches that may be adapted to optimize carbon sequestration.

FIG. 5 illustrates a process in which $MgCO_3$ is formed by direct neutralization of the Fe/Al/Mn depleted solution, so that $Na_2CO_3$, for example produced in and recovered from a direct air capture (DAC) process, reacts with $MgCl_{2(aq)}$ in the Fe/Al/Mn depleted solution to form $MgCO_{3(s)}$:

$$MgCl_2+Na_2CO_3=MgCO_3+2NaCl$$

In select embodiments, essentially the full amount of NaOH produced by the chloralkali process is directed to the DAC system to produce $Na_2CO_3$ from $CO_2$ captured directly from the atmosphere. In such a process, sufficient $Na_2CO_3$ is produced to provide the alkali metal precipitant for all aspects of the process, including recovery of $MgCO_3$. In this way, sorbent regeneration for DAC, i.e. NaOH, is combined with long term mineralisation of the $CO_2$. $MgCO_3$ mineralisation thereby creates carbon negative products in the form of carbonates, that may for example be used as filler or construction aggregate.

FIG. 6 illustrates an alternative process involving the formation of $MgCO_3$ by direct addition of $CO_2$ gas, with addition of NaOH, to the Fe/Al/Mn depleted solution, to react with $MgCl_{2(aq)}$ in solution to form $MgCO_{3(s)}$:

$$MgCl_2+2NaOH+CO_{2(g)}=MgCO_3+2NaCl+H_2O$$

As illustrated in FIG. 6, a portion of NaOH from the chloralkali process may be directed to the Mg precipitation stage, together with $CO_{2(g)}$ (for example recovered as a $CO_2$ off gas from iron and aluminum precipitation with $Na_2CO_3$), forming $MgCO_3$ in-situ. Alternatively, $CO_{2(g)}$ for Mg carbonate precipitation may come from sources external to the present process.

Reactions in various stages of the present process may be represented as follows:

Neutralization

Alkali hydroxide: $2HCl+2NaOH=2NaCl+2H_2O$

Alkali metal carbonate: $2HCl+Na_2CO_3=2NaCl+H_2O+CO_{2(g)}$

Iron Precipitation

Alkali hydroxide: $2FeCl_3+6NaOH=2FeO(OH)+2H_2O+6NaCl$ $2FeCl_3+6NaOH=Fe_2O_3$ (hematite)$+6NaCl+3H_2O$ Alkali metal carbonate: $2FeCl_3+3Na_2CO_3+H_2O=2FeO(OH)+6NaCl+3CO_{2(g)}$ Nickel Recovery Alkali hydroxide: $NiCl_2+2NaOH=Ni(OH)_2+2NaCl$ Alkali metal carbonate: $NiCl_2+Na_2CO_3=NiCO_3+2NaCl$ Magnesium Recovery Alkali hydroxide: $MgCl_2+2NaOH=Mg(OH)_2+2NaCl$ Alkali metal carbonate: $MgCl_2+Na_2CO_3=MgCO_3+2NaCl$ Direct $CO_2$: $MgCl_{2+2}NaOH+CO_{2(g)}=MgCO_3+2NaCl+H_2O$ In alternative embodiments, $NaHCO_3$ may take the place of $Na_2CO_3$ in reactions in various stages of the present process.

FIGS. 7-10 illustrate processes in which metal values are leached from a comminuted ("crushing and grinding") mineral feedstock with a sulfuric acid leachant ("$H_2SO_4$ leaching"), to produce a solid siliceous residue ("Amorphous Silica Residue for Cement Manufacture") and a loaded leach solution. As illustrated, the residue may be washed.

Figure 8:
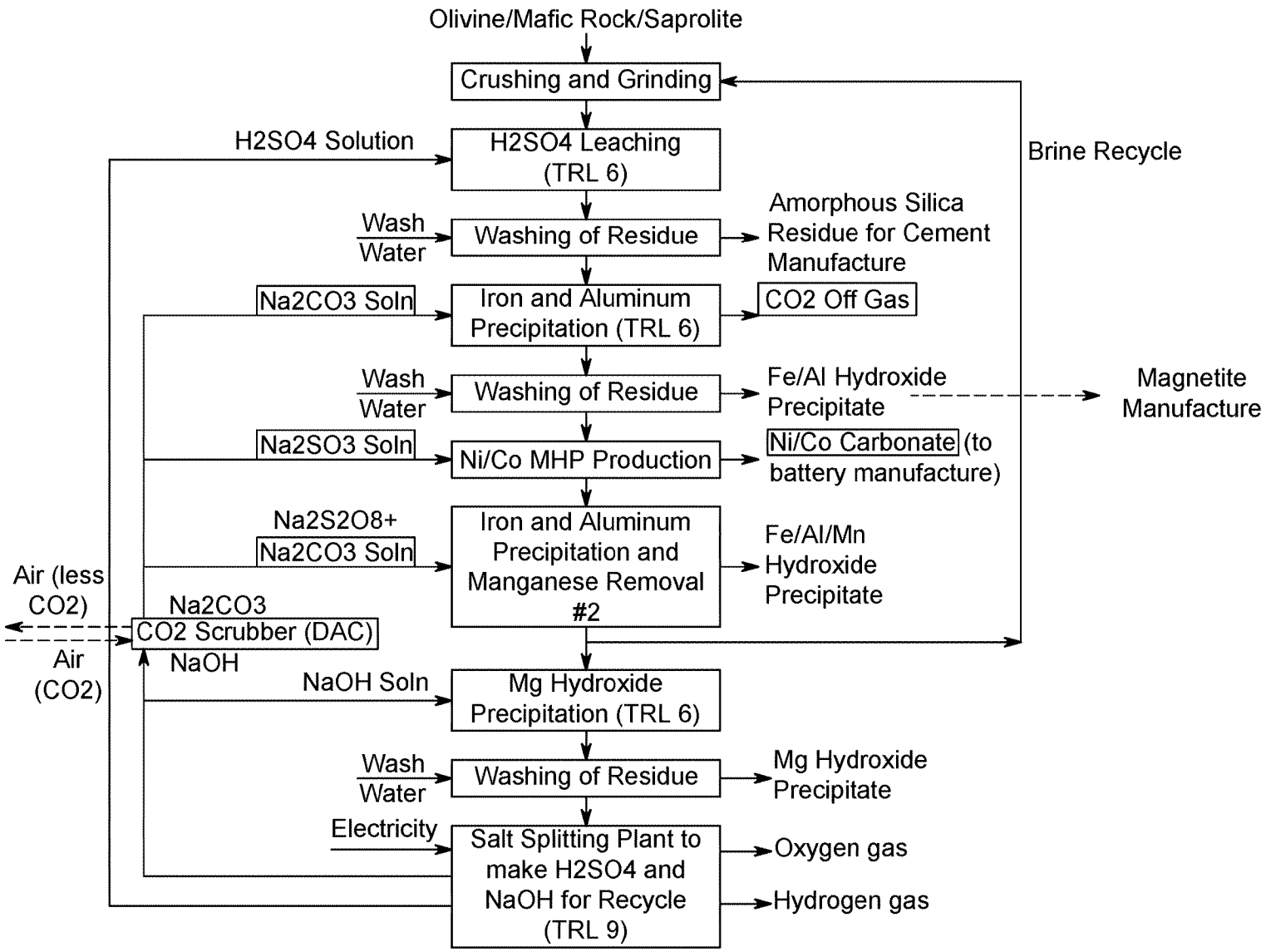
FIG. 8 is a schematic illustration of an integrated process for hydrometallurgical value extraction from a mineral feedstock, with reactants for the hydrometallurgical process provided by capture of carbon dioxide (DAC) and an electrolytic salt splitting anion exchange process.
Figure 9:
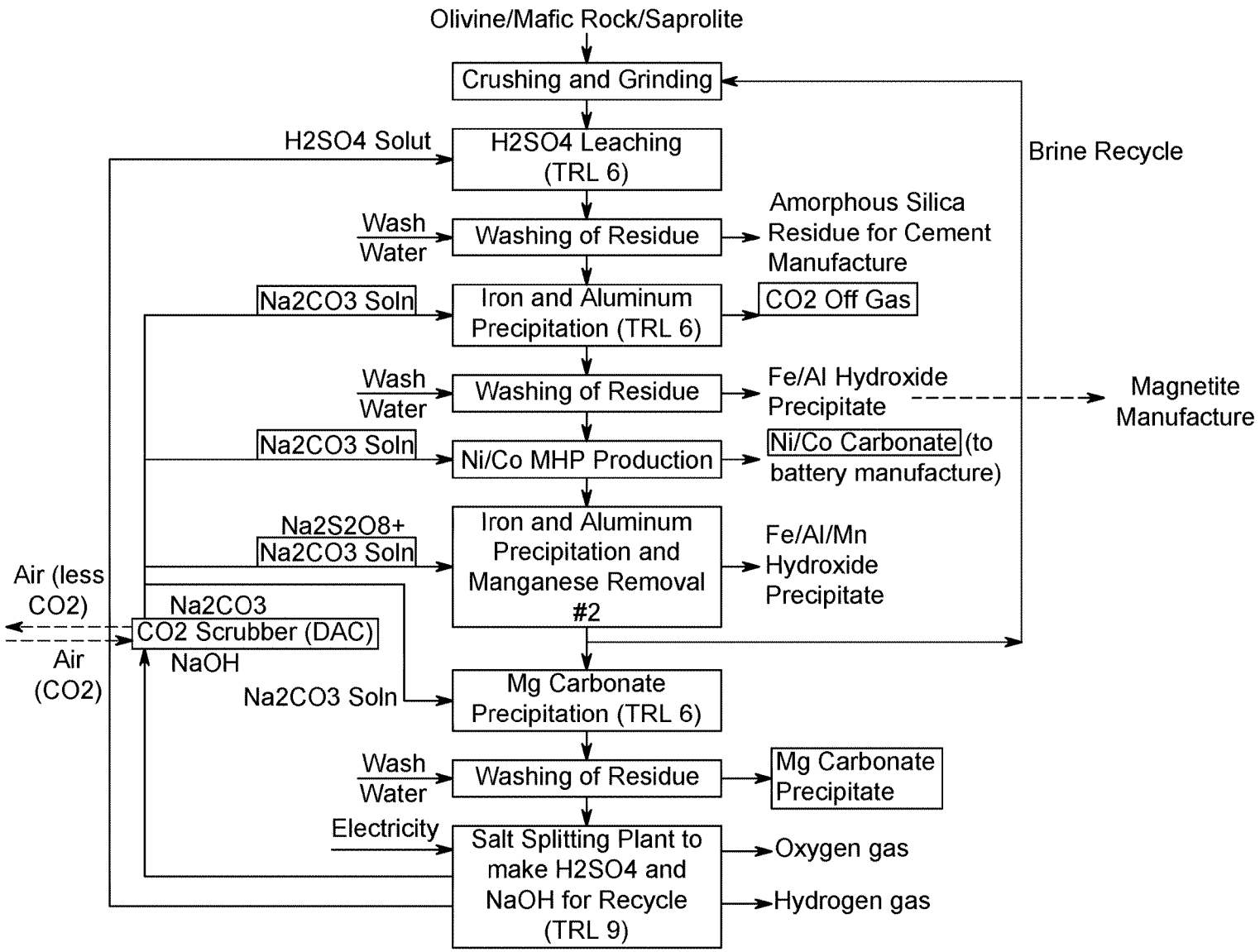
FIG. 9 is a schematic illustration of an integrated process for hydrometallurgical value extraction from a mineral feedstock, with reactants for the hydrometallurgical process provided by capture of carbon dioxide (DAC) and an electrolytic salt splitting anion exchange process.
Figure 10:
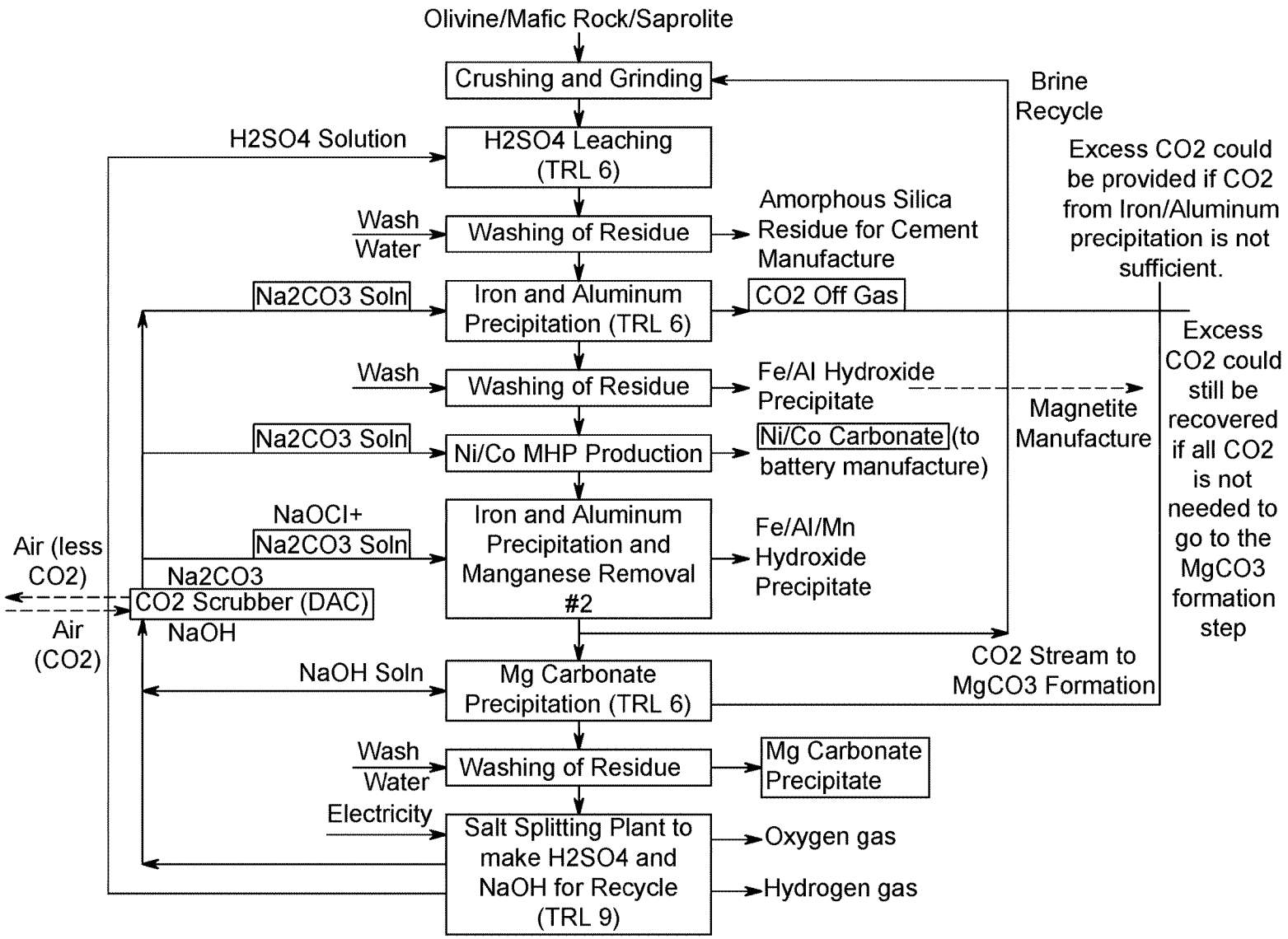
FIG. 10 is a schematic illustration of an integrated process for hydrometallurgical value extraction from a mineral feedstock, with reactants for the hydrometallurgical process provided by capture of carbon dioxide (DAC) and an electrolytic salt splitting anion exchange process.

Iron and/or aluminum are precipitated ("Iron and Aluminum Precipitation") from the loaded leach solution with either an alkali hydroxide precipitant (FIG. 7) or an alkali metal carbonate or bicarbonate precipitant ($Na_2CO_3$ FIGS. 8-10). Use of the alkali metal carbonate or bicarbonate precipitant produces a carbon dioxide off gas ("$CO_2$ Off Gas"), an Fe/Al depleted solution and an iron and/or aluminum hydroxide or oxide precipitate product ("Fe/Al Hydroxide Precipitate", which may be an oxide, such as hematite). The concentrated $CO_2$ Off Gas may be sequestered using a variety of approaches. As illustrated, the residue may be washed to provide the precipitate, and the precipitate may be used in magnetite manufacture.

Nickel and/or cobalt are precipitated from the Fe/Al depleted solution with the alkali hydroxide precipitant (e.g. NaOH, FIG. 7) or the alkali metal carbonate or bicarbonate precipitant (e.g. $Na_2CO_3$, FIGS. 8-10), to produce a Ni/Co depleted solution and a nickel and/or cobalt hydroxide (FIG. 1, "MHP") or carbonate precipitate product (FIGS. 8-10, "Ni/Co Carbonate (to battery manufacture)").

Iron and/or aluminum and/or manganese may be scrubbed from the Ni/Co depleted solution with the alkali hydroxide precipitant (FIG. 7) or with the alkali metal carbonate or bicarbonate precipitant (FIGS. 8-10, $Na_2CO_3$) and an oxidant, such as the illustrated sodium persulfate ($Na_2S_2O_8$), to produce an Fe/Al/Mn depleted solution and an iron and/or aluminum and/or manganese hydroxide precipitate product ("Fe/Al/Mn Hydroxide Precipitate").

As illustrated, brine comprising the Fe/Al/Mn depleted solution may be recycled to the comminuting step to provide the comminuted mineral feedstock.

Magnesium may be precipitated from the Fe/Al/Mn depleted solution with the alkali hydroxide precipitant (NaOH as illustrated in FIGS. 7 and 8), or with the alkali metal carbonate or bicarbonate precipitant (FIG. 9) or with a combined feed of the alkali hydroxide precipitant and $CO_2$ (in a carbon dioxide capture step, FIG. 10) to produce a Mg-depleted solution and a magnesium hydroxide (FIGS. 7 and 8) or carbonate (FIGS. 9 and 10) precipitate product, The Mg-depleted solution may then be subjected to an electrolysis to produce the alkali hydroxide precipitant and the acid leachant ("Salt Splitting Plant to make $H_2SO_4$ and NaOH for Recycle").

Carbon dioxide may be scrubbed from a $CO_2$ containing gas ("Air" as illustrated) by treating the $CO_2$ containing gas with a scrubbing solution comprising the alkali hydroxide precipitant (NaOH as illustrated), to produce one or more of the first, second, third and fourth alkali metal carbonate or bicarbonate precipitants ($Na_2CO_3$ as illustrated), for use respectively in i) iron and aluminum precipitation, ii) Ni/Co precipitation, iii) iron and aluminum precipitation with manganese removal, and iv) Mg precipitation.

In the foregoing process, the step of scrubbing carbon dioxide from the $CO_2$ containing gas may include a crystallisation step to precipitate $Na_2CO_3$ hydrates from the scrubbing solution, the alkali hydroxide precipitant being NaOH. The solid $Na_2CO_3$ crystallizer product may then be directed to provide one or more of the alkali metal carbonate or bicarbonate precipitants.

The process acid leachant as illustrated is $H_2SO_4$. As such, processes are provided that use of a sulfate based system for treatment of magnesium silicates. In select embodiments, (FIG. 7) $H_2SO_4/NaOH/Na_2SO_4$ salt splitting is used to produce amorphous silica for cementing, iron residue, mixed nickel and cobalt hydroxide and magnesium hydroxide—which is then available for carbon sequestration. In alternative embodiments, various direct air carbon capture (DAC) steps are integrated into the sulfate system (FIGS. 8-10). In particular, FIG. 8 illustrates a process wherein a portion of the alkali hydroxide precipitant NaOH is used to remove $CO_2$ from air. The resulting sodium carbonate is then used in the iron removal and the nickel/cobalt precipitation stages. FIG. 9 illustrates a process in which there is complete use of NaOH for DAC to form $Na_2CO_3$. The addition of $Na_2CO_3$ to the Mg precipitation stage results in $MgCO_3$ precipitation directly for carbon sequestration. FIG. 10 illustrates an alternative embodiment in which the alkali hydroxide precipitant NaOH is combined with $CO_2$ added directly to the Mg precipitation stage, to form $MgCO_3$.

Steps in the sulfate process may be characterized by reactions therein, as follows:

Acid Leaching (Simplified);

$Mg_2SiO_4+2H_2SO_4=2MgSO_4+SiO_2+2H_2O$ $Ni_2SiO_4+2H_2SO_4=2NiSO_4+SiO_2+2H_2O$ $Co_2SiO_4+2H_2SO_4=2CoSO_4+SiO_2+2H_2O$ $Fe_2SiO_4+2H_2SO_4=2FeSO_4+SiO_2+2H_2O$ $MnO_2+2FeSO_4+2H_2SO_4=MnSO_4+Fe_2(SO_4)_3+2H_2O$ $2FeO(OH)+3H_2SO_4=Fe_2(SO_4)_3+4H_2O$ $2Al(OH)+3H_2SO_4=Al_2(SO_4)_3+4H_2O$

Iron/Aluminum Removal (with Product);

$H_2SO_4+2NaOH=Na_2SO_4+2H_2O$ $Al_2(SO_4)_3+6NaOH=2Al(OH)_3+3Na_2SO_4$ (Aluminum hydroxide)

$Fe_2(SO_4)_3+6NaOH=2Fe(OH)_3+3Na_2SO_4$ (Iron hydroxide)

$Al_2(SO_4)_3+6NaOH=2Al(OH)+3Na_2SO_4+2H_2O$ (Aluminum oxyhydroxide)

$Fe_2(SO_4)_3+6NaOH=2FeO(OH)+3Na_2SO_4+2H_2O$ (Iron oxyhydroxide)

$Fe_2(SO_4)_3+6NaOH=Fe_2O_3+3Na_2SO_4+3H_2O$ (hematite)

$3Al_2(SO_4)_3+12NaOH=2NaAl_3(SO_4)_2(OH)_6+5Na_2SO_4$ (Alunite)

$3Fe_2(SO_4)_3+12NaOH=2NaFe_3(SO_4)_2(OH)_6+5Na_2SO_4$ (Jarosite)

Nickel and Cobalt Precipitation $NiSO_4+2NaOH=Ni(OH)_2+Na_2SO_4$ $CoSO_4+2NaOH=Co(OH)_2+Na_2SO_4$ Iron/Aluminum/Manganese Removal Stage 2

$Al_2(SO_4)_3+6NaOH=2Al(OH)_3+3Na_2SO_4$ (Aluminum hydroxide)

$Fe_2(SO_4)_3+6NaOH=2Fe(OH)_3+3Na_2SO_4$ (Iron hydroxide)

$Al_2(SO_4)_3+6NaOH=2Al(OH)+3Na_2SO_4+2H_2O$ (Aluminum oxyhydroxide)

$Fe_2(SO_4)_3+6NaOH=2FeO(OH)+3Na_2SO_4+2H_2O$ (Iron oxyhydroxide)

$3Al_2(SO_4)_3+12NaOH=2NaAl_3(SO_4)_2(OH)_6+5Na_2SO_4$ (Alunite)

$3Fe_2(SO_4)_3+12NaOH=2NaFe_3(SO_4)_2(OH)_6+5Na_2SO_4$ (Jarosite)

$MnSO_4+Na_2S_2O_8+4NaOH=MnO_2+3Na_2SO_4+2H_2O$

Magnesium Hydroxide Precipitation $MgSO_4+2NaOH=Mg(OH)_2+Na_2SO_4$

Salt Splitting (Anion Exchange Membrane)

$2Na_2SO_4+4H_2O=4NaOH+2H_2SO_4+2H_2+O_2$

In alternative embodiments, processes make use of NaOH, $NaHCO_2$ or $Na_2CO_3$ precipitants, with some alternative chemistries shown below:

Neutralization

Alkali hydroxide: $H_2SO_4+2NaOH=Na_2SO_4+2H_2O$

Alkali metal carbonate: $H_2SO_4+Na_2CO_3=Na_2SO_4+H_2O+CO_{2(g)}$

Iron Precipitation

Alkali hydroxide: $Fe_2(SO_4)_3+6NaOH=2Fe(OH)_3+3Na_2SO_4$ or $Fe_2(SO_4)_3+6NaOH=Fe_2O_3+3Na_2SO_4+3H_2O$ Alkali metal carbonate: $Fe_2(SO_4)_3+3Na_2CO_3+H_2O=2FeO(OH)+3Na_2SO_4+3CO_{2(g)}$ Nickel Recovery Alkali hydroxide: $NiSO_4+2NaOH=Ni(OH)_2+Na_2SO_4$ Alkali metal carbonate: $NiSO_4+Na_2CO_3=NiCO_3+Na_2SO_4$ Magnesium Recovery Alkali hydroxide: $MgSO_4+2NaOH=Mg(OH)_2+Na_2SO_4$ Alkali metal carbonate (with $Na_2CO_3$): $MgSO_4+Na_2CO_3=MgCO_3+Na_2SO_4$ Alkali metal carbonate with $NaOH/CO_{2(g)}$: $MgSO_4+2NaOH+CO_2=MgCO_3+Na_2SO_4+H_2O$ The present processes may be integrated with other carbon sequestration processes, such as ocean alkalinity enhancement. This present processes for the production of synthetic brucite and calcium hydroxide accordingly address environmental risks of direct ocean alkalinity enhancement with untreated mafic rocks. The present processes also create a less carbon intensive source of magnesium and calcium hydroxides to be used as feedstock in carbon capture and storage, including direct air capture technologies. The use of the brucite or calcium hydroxide products of the present processes in a direct air capture (DAC) process may be carried out so as to eliminate calcining and slacking steps that are otherwise required in these processes. The present processes provide for the use of basaltic sands in less carbon intensive industrial purposes, by producing low carbon sources of nickel and iron hydroxides as well as amorphous silicate ($SiO_2$).

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Terms such as "exemplary" or "exemplified" are used herein to mean "serving as an example, instance, or illustration." Any implementation described herein as "exemplary" or "exemplified" is accordingly not to be construed as necessarily preferred or advantageous over other implementations, all such implementations being independent embodiments. Unless otherwise stated, numeric ranges are inclusive of the numbers defining the range, and numbers are necessarily approximations to the given decimal. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification, and all documents cited in such documents and publications, are hereby incorporated herein by reference as if each individual publication were specifically and individually indicated to be incorporated by reference herein and as though fully set forth herein. The invention includes all embodiments and variations substantially as hereinbefore described and with reference to the examples and drawings.

The invention claimed is:

1. A process for processing a comminuted nickel saprolite mineral feedstock, comprising:

a) leaching iron, aluminum, nickel, cobalt, manganese and magnesium metal values from the comminuted mineral feedstock with an HCl acid leachant, to produce a solid siliceous residue and a loaded leach solution;

b) precipitating iron and/or aluminum from the loaded leach solution with addition of:
a first NaOH alkali hydroxide precipitant,
to produce an Fe/Al depleted solution and an iron and/or aluminum hydroxide or oxide precipitate product;

c) precipitating nickel and cobalt from the Fe/Al depleted solution, wherein the precipitating is with addition of:
a second NaOH alkali hydroxide precipitant,
to produce a Ni/Co depleted solution and a nickel and cobalt mixed hydroxide precipitate product;

d) precipitating Fe/Al/Mn from the Ni/Co depleted solution with addition of an oxidant and with addition of:
a third NaOH alkali hydroxide precipitant,
to produce an Fe/Al/Mn depleted solution and a manganese hydroxide precipitate product;

e) precipitating magnesium from the Fe/Al/Mn depleted solution with addition of:
a fourth NaOH alkali hydroxide precipitant,
to produce a Mg-depleted solution and a magnesium hydroxide precipitate product;

f) subjecting the Mg-depleted solution to a chloralkali process producing the NaOH alkali hydroxide precipitant, a $Cl_2(g)$ product and a $H_2(g)$ product, further comprising reacting the $Cl_2(g)$ product and the $H_2(g)$ product to produce HCl as the HCl acid leachant.

2. The process of claim 1, further comprising reacting the NaOH alkali hydroxide product of the electrolysis process with a $CO_2$ containing gas, thereby scrubbing carbon dioxide from the $CO_2$ containing gas to produce an alkali metal carbonate or bicarbonate comprising $NaHCO_3$ or $Na_2CO_3$.

3. The process of claim 2, wherein scrubbing carbon dioxide from the $CO_2$ containing gas comprises precipitating $Na_2CO_3$ hydrates in a crystallisation process to produce a solid $Na_2CO_3$ crystallizer product.

4. The process of claim 1, wherein the oxidant comprises chlorine gas $Cl_2(g)$ or sodium hypochlorite (NaOCl).

5. The process of claim 1, further comprising magnetically separating material from the comminuted mineral feedstock.

6. The process of claim 1, further comprising subjecting the loaded leach solution to a resin in leach process so as to selectively remove nickel values from the loaded leach solution, to obtain a purified nickel product.

7. The process of claim 1, further comprising washing and/or alkalization of the solid siliceous residue.

8. The process of claim 1, further comprising washing and/or alkalization of the iron and/or aluminum hydroxide or oxide precipitate product.

9. The process of claim 1, further comprising adding a hematite seed material to the step of precipitating iron and/or aluminum so as to seed the precipitation of a hematite product.

10. The process of claim 1, wherein the iron and/or aluminum hydroxide or oxide precipitate product comprises a hematite seed material, and the hematite seed material is recirculated to the step of precipitating iron and/or aluminum so as to seed the precipitation of a hematite product.

11. The process of claim 1, further comprising recycling a brine comprising the Fe/Al/Mn depleted solution to a comminuting step to provide the comminuted mineral feedstock.

* * * * *